US012668386B2

(12) United States Patent
Höhn

(10) Patent No.: US 12,668,386 B2
(45) Date of Patent: Jun. 30, 2026

(54) STRAPPING MACHINE STRAP-FEEDING ASSEMBLY FOR REDUCING DRIVE-ROLLER SLIPPAGE

(71) Applicant: Signode Industrial Group LLC, Tampa, FL (US)

(72) Inventor: Jürgen Höhn, Bad Berneck (DE)

(73) Assignee: Signode Industrial Group LLC, Tampa, FL (US)

( * ) Notice: Subject to any disclaimer, the term of this patent is extended or adjusted under 35 U.S.C. 154(b) by 0 days.

(21) Appl. No.: 18/839,841

(22) PCT Filed: Feb. 16, 2023

(86) PCT No.: PCT/US2023/062705
§ 371 (c)(1),
(2) Date: Aug. 20, 2024

(87) PCT Pub. No.: WO2023/164396
PCT Pub. Date: Aug. 31, 2023

(65) Prior Publication Data

US 2025/0236422 A1 Jul. 24, 2025

Related U.S. Application Data

(60) Provisional application No. 63/268,442, filed on Feb. 24, 2022.

(51) Int. Cl.

| | |
|---|---|
| ***B65B 13/22*** | (2006.01) |
| ***B65B 13/06*** | (2006.01) |
| ***B65B 13/32*** | (2006.01) |
| ***B65B 57/04*** | (2006.01) |

(52) U.S. Cl.
CPC ..... *B65B 13/22* (2013.01); *B65B 13/06* (2013.01); *B65B 13/32* (2013.01); *B65B 57/04* (2013.01)

(58) Field of Classification Search
CPC ..... B65B 13/06; B65B 13/22; B65B 13/184; B65B 13/32; B65B 57/04
See application file for complete search history.

(56) References Cited

U.S. PATENT DOCUMENTS

| | | | |
|---|---|---|---|
| 4,153,499 | A | 5/1979 | Annis |
| 4,699,027 | A | 10/1987 | Guyette et al. |
| 4,955,180 | A | 9/1990 | Sakaki et al. |
| 5,333,438 | A | 8/1994 | Gurak et al. |

(Continued)

FOREIGN PATENT DOCUMENTS

| | | | |
|---|---|---|---|
| CN | 102131596 | B | 3/2014 |
| EP | 2125527 | B1 | 5/2012 |

(Continued)

OTHER PUBLICATIONS

"International Search Report and Written Opinion", from corresponding International Patent Application No. PCT/US2023/062705, Jul. 14, 2023.

*Primary Examiner* — Andrew M Tecco
(74) *Attorney, Agent, or Firm* — Neal, Gerber & Eisenberg LLP

(57) ABSTRACT

Various embodiments of the present disclosure provide a strapping machine strap-feeding assembly that changes the speed of its drive roller from one strap-feeding cycle to the next or during a single strap-feeding cycle to reduce slippage between the drive roller and the strap.

10 Claims, 5 Drawing Sheets

(56) References Cited

U.S. PATENT DOCUMENTS

| | | | | |
|---|---|---|---|---|
| 5,516,022 | A | 5/1996 | Annis | |
| 5,809,873 | A * | 9/1998 | Chak | B65B 13/22 100/29 |
| 6,038,967 | A * | 3/2000 | Chak | B65B 13/22 53/64 |
| 7,770,369 | B2 * | 8/2010 | Doyle | B65B 13/184 53/399 |
| 8,584,438 | B2 * | 11/2013 | Doyle | B65B 13/184 53/399 |
| 9,745,091 | B2 * | 8/2017 | Doyle | B65B 13/184 |
| 10,821,492 | B2 | 11/2020 | Yeo | |
| 10,865,004 | B2 | 12/2020 | Tanner | |
| 11,021,282 | B2 * | 6/2021 | Elliott | B65B 13/185 |
| 11,027,866 | B2 | 6/2021 | Neumann et al. | |
| 11,332,270 | B2 | 5/2022 | Englund et al. | |
| 11,577,867 | B2 * | 2/2023 | Elliott | B65B 13/22 |
| 11,634,243 | B2 | 4/2023 | Cunha et al. | |
| 12,024,320 | B2 * | 7/2024 | Banholzer | B65B 13/185 |
| 2008/0256900 | A1 * | 10/2008 | Doyle | B65B 13/184 53/399 |
| 2011/0011039 | A1 * | 1/2011 | Doyle | B65B 13/184 53/589 |
| 2014/0130686 | A1 * | 5/2014 | Doyle | B65B 13/184 100/2 |
| 2019/0023431 | A1 * | 1/2019 | Elliott | B65B 57/00 |
| 2021/0269183 | A1 * | 9/2021 | Elliott | B65B 13/18 |

FOREIGN PATENT DOCUMENTS

| | | | |
|---|---|---|---|
| EP | 3501995 | A1 | 6/2019 |
| EP | 3556667 | A1 | 10/2019 |
| EP | 3778407 | A1 | 2/2021 |
| EP | 4192739 | A1 | 6/2023 |
| GB | 180972 | A | 5/1922 |
| GB | 2041869 | B | 12/1982 |
| KR | 20200040584 | A | 4/2020 |
| KR | 102482693 | B1 | 12/2022 |
| KR | 102482694 | B1 | 12/2022 |
| WO | 2021095931 | A1 | 5/2021 |
| WO | 2022010028 | A1 | 1/2022 |

* cited by examiner

STRAPPING MACHINE STRAP-FEEDING ASSEMBLY FOR REDUCING DRIVE-ROLLER SLIPPAGE

PRIORITY CLAIM

This application is a national phase application of PCT/US2023/062705, filed on Feb. 16, 2023, which claims priority to and the benefit of U.S. Provisional Patent Application No. 63/268,442, filed Feb. 24, 2022, the entire contents of which is incorporated herein by reference.

FIELD

The present disclosure relates to a strap-feeding assembly for a strapping machine, and more particularly to a strap-feeding assembly that changes the speed of its drive roller from one strap-feeding cycle to the next or during a single strap-feeding cycle to reduce slippage between the drive roller and the strap.

BACKGROUND

A strapping machine forms a tensioned loop of plastic strap (such as polyester or polypropylene strap), metal strap (such as steel strap), or paper strap around a load. A typical strapping machine includes a support surface that supports the load, a strap chute that circumscribes the support surface, a strapping head that forms the strap loop, a controller that controls the strapping head to strap the load, and a frame that supports these components. A typical strapping head includes a strap-feeding assembly for feeding strap from a strap supply into and around the strap chute and for retracting the strap so it exits the strap chute and moves radially inwardly into contact with the load, a strap-tensioning assembly for tensioning the strap around the load, and a strap-sealing assembly for cutting the strap from the strap supply and attaching two areas of the strap together to form the strap loop. The strapping head includes several guides that define strap channels that the strap passes through as it moves between the various assemblies of the strapping head. The strap channels and the strap chute together define a strap path that the strap moves through.

To strap the load, the strapping machine carries out a strapping cycle including a strap-feeding cycle, a strap-retraction cycle, a strap-tensioning cycle, and a strap-sealing cycle. The strapping machine first carries out the strap-feeding cycle during which the strap-feeding assembly feeds strap (with the leading strap end first) from the strap supply through the strap-tensioning assembly, through the strap-sealing assembly, and into and around the strap chute until the leading strap end returns to the strap-sealing assembly. The strapping machine then carries out the strap-retraction cycle during which the strap-sealing assembly holds the leading strap end while the strap-feeding assembly retracts the strap to pull the strap out of the strap chute and onto and around the load. The strapping machine then carries out the strap-tensioning cycle during which the strap-tensioning assembly tensions the strap to a designated strap tension. The strapping machine then carries out the strap-sealing cycle during which the strap-sealing assembly cuts the strap from the strap supply to form a trailing strap end and attaches the leading and trailing strap ends to one another, thereby forming a tensioned strap loop around the load and completing the strapping cycle.

A successful strapping cycle begins with a successful strap-feeding cycle in which the strap-feeding assembly successfully feeds the strap around the strap chute. Many things can negatively impact the strap-feeding assembly's ability to complete a successful strap-feeding cycle. The drive and pinch rollers of the strap-feeding assembly that cooperate to feed the strap will, over time, degrade due to the wear and tear imposed by completing thousands of strapping cycles. But known strapping machines do not account for this wear and drive the drive roller in the same manner after 1,000 strapping cycles as they do after 10 strapping cycles. This results in the worn drive roller slipping relative to the strap, with the slipping becoming more severe as the drive roller wears. This slipping prolongs the strapping cycle by requiring more drive-roller rotations—and thus more time—for the strap to traverse the strap chute. It can also damage the strap via the friction and heat generated by the slipping drive roller. And in a worst-case scenario, a worn drive roller will not feed the strap completely around the strap chute, requiring the operator to shut down the strapping machine to investigate the cause of the problem. The drive roller (and the strapping machine's performance) can suffer a similar fate if the operator allows dirt or other debris to build up on the drive roller. Additionally, many different types of strap are fed through the strapping machine, including straps having different compositions and straps made via different manufacturing processes. Different types of strap have different properties, which can lead to slippage since known strapping machines are typically calibrated to deal with all of these types of strap rather than for the specific type of strap currently being used. For instance, certain types of strap are slipperier than others, and a drive roller can experience slippage when attempting to feed more slippery strap in the same manner as less slippery strap. Additionally, certain manufacturing processes can result in slight strap deformation—such as curling across the width of the strap—that can increase the likelihood of drive roller slippage.

SUMMARY

Various embodiments of the present disclosure provide a strapping machine strap-feeding assembly that changes the speed of its drive roller from one strap-feeding cycle to the next or during a single strap-feeding cycle to reduce slippage between the drive roller and the strap.

Various embodiments of the present disclosure provide a strapping machine including: a drive roller; an actuator operably connected to the drive roller to drive the drive roller; a rotatable pinch roller that forms a nip with the drive roller sized to receive strap therethrough; a drive-roller sensor configured to sense a drive-roller parameter of the drive roller; a pinch-roller sensor configured to sense a pinch-roller parameter of the pinch roller; and a controller operably connected to the actuator and communicatively connected to the drive-roller and pinch-roller sensors. The controller is configured to: after initiation of a strap-feeding cycle, control the actuator in accordance with one or more actuator control instructions to drive the drive roller to feed the strap through the strapping machine; determine a drive-roller rotational property of the drive roller based on one or more sensed drive-roller rotational parameters; determine a pinch-roller rotational property of the pinch roller based on one or more sensed pinch-roller rotational parameters; determine whether a slip condition has been met based on a comparison of the drive-roller rotational property with the pinch-roller rotational properties; and responsive to determining that the slip condition has been met, change at least one of the one or more actuator control instructions to reduce the rotational speed of the drive roller.

Various embodiments of the present disclosure provide a method of operating a strapping machine, the method including: after initiation of a strap-feeding cycle, driving an actuator in accordance with one or more actuator control instructions to drive a drive roller to feed the strap through the strapping machine; determining a drive-roller rotational property of the drive roller based on one or more sensed drive-roller rotational parameters; determining a pinch-roller rotational property of the pinch roller based on one or more sensed pinch-roller rotational parameters; determining whether a slip condition has been met based on a comparison of the drive-roller rotational property with the pinch-roller rotational properties; and responsive to determining that the slip condition has been met, changing at least one of the one or more actuator control instructions to reduce the rotational speed of the drive roller.

DETAILED DESCRIPTION

Figure 1:
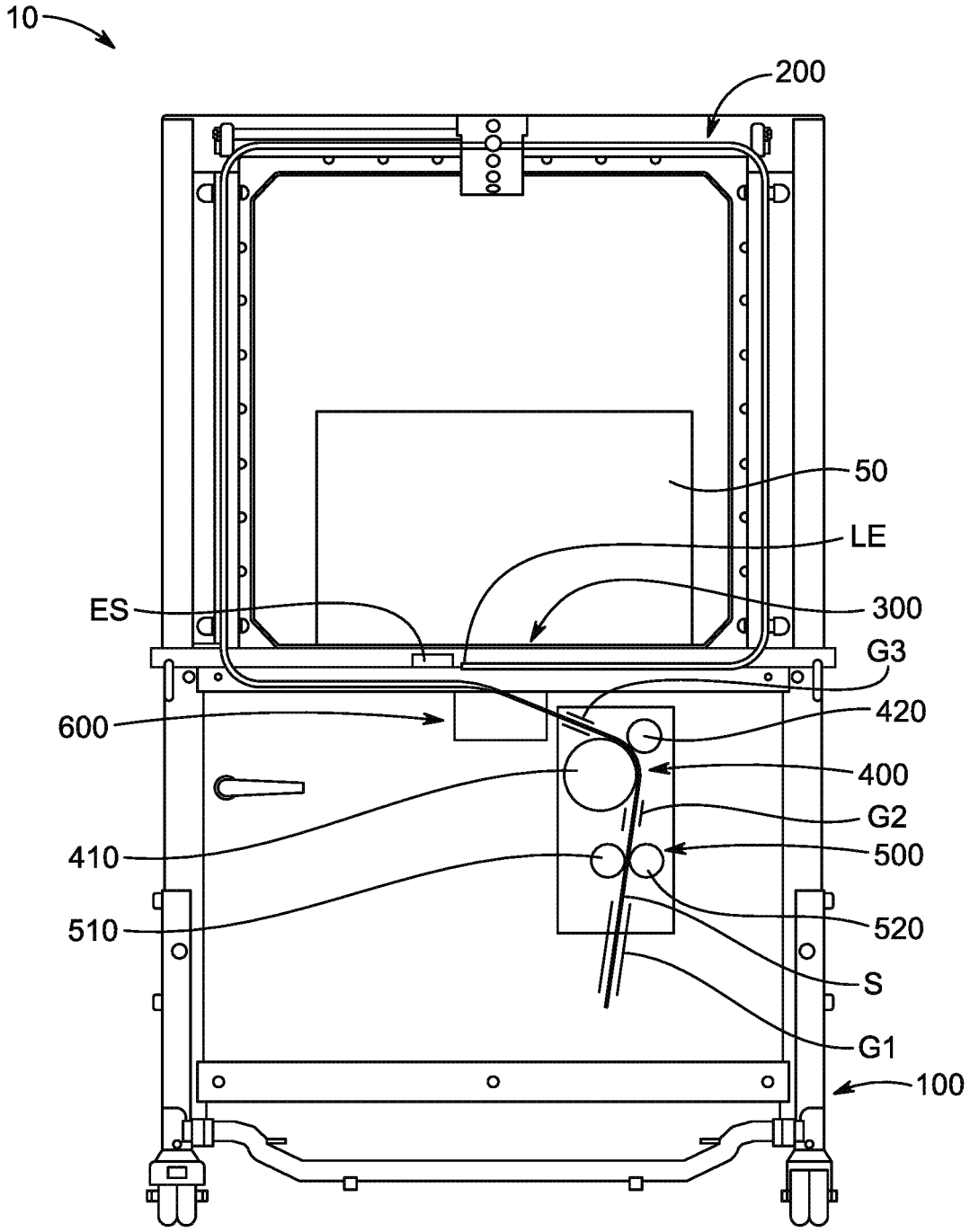
FIG. 1 is a diagrammatic side view of one example embodiment of a strapping machine of the present disclosure.

While the systems, devices, and methods described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as mounted, connected, etc., are not intended to be limited to direct mounting methods but should be interpreted broadly to include indirect and operably mounted, connected, and like mounting methods. This specification is intended to be taken as a whole and interpreted in accordance with the principles of the present disclosure and as understood by one of ordinary skill in the art.

Figure 2:
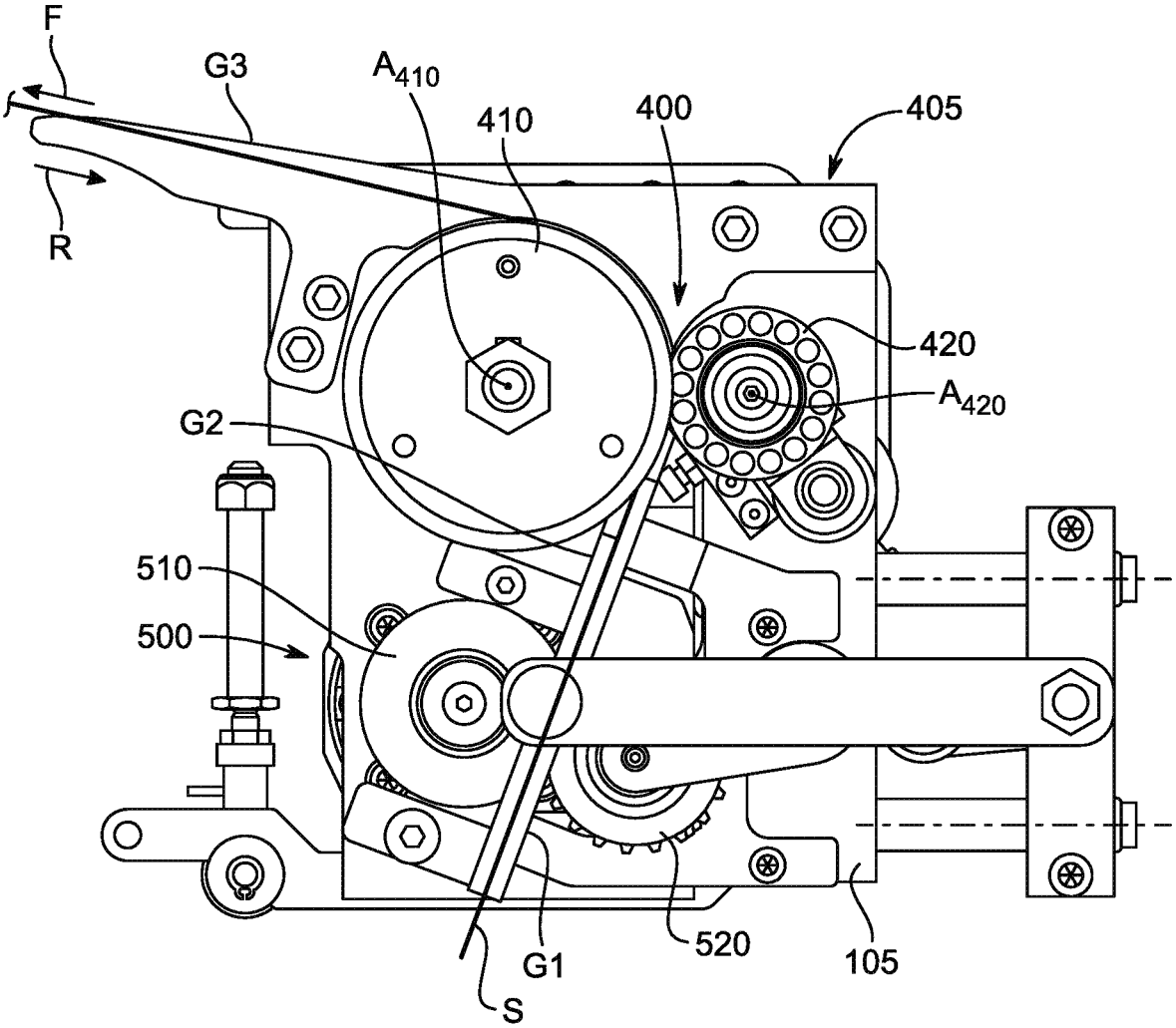
FIG. 2 is a side view of the strap-feeding and strap-tensioning assemblies of the strapping machine of FIG. 1.
Figure 3:
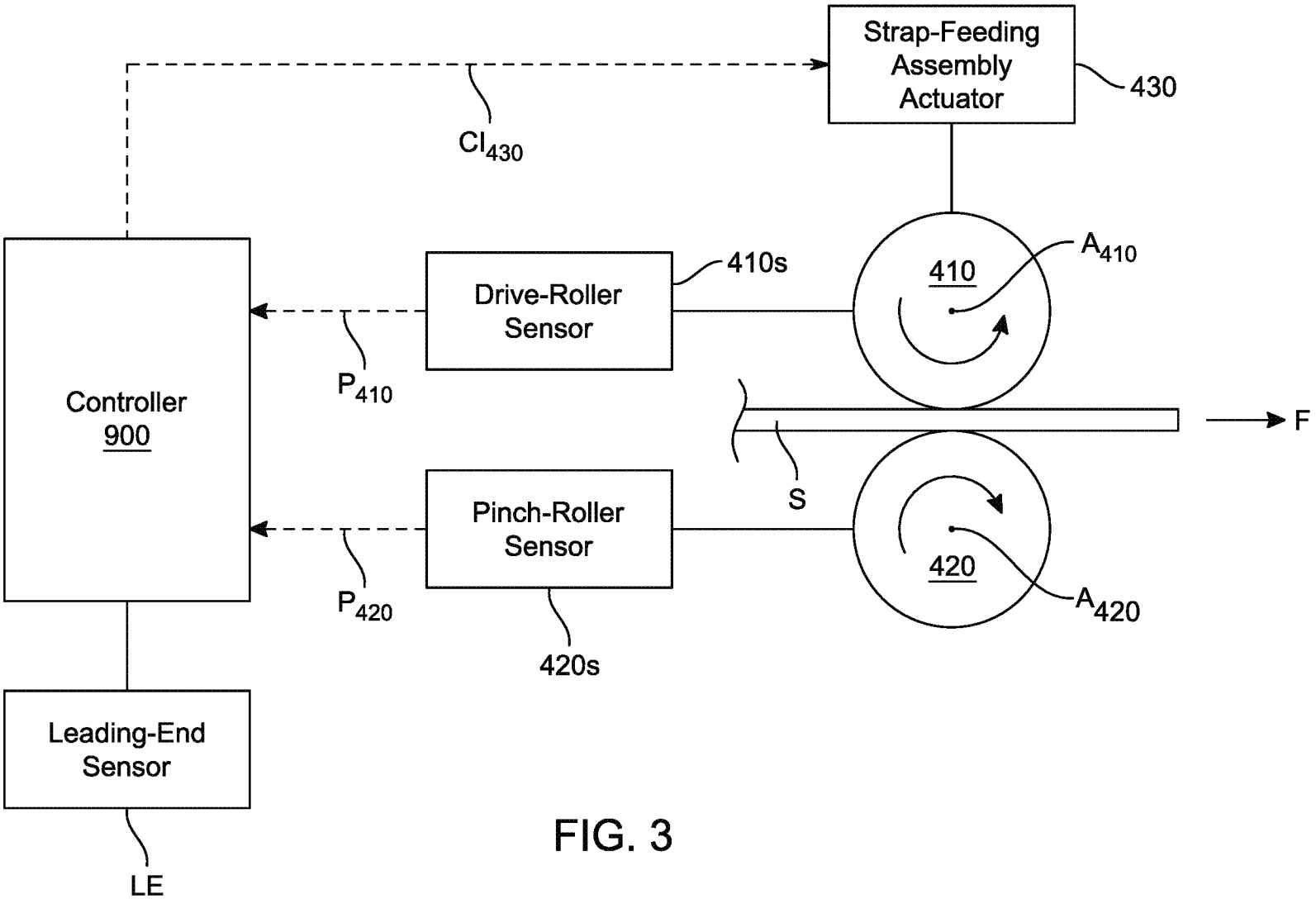
FIG. 3 is a block diagram showing certain of the components of the strapping machine of FIG. 1.

Various embodiments of the present disclosure provide a strapping machine strap-feeding assembly that changes the speed of its drive roller from one strap-feeding cycle to the next or during a single strap-feeding cycle to reduce slippage between the drive roller and the strap. FIGS. 1-3 show one example embodiment of a strapping machine 10 of the present disclosure and components thereof. The strapping machine 10 is configured to form a tensioned loop of strap S drawn from a strap supply (not shown) around a load, and includes a frame 100; a strap chute 200; a load supporter 300; a strap-feeding assembly 400; a strap-tensioning assembly 500; a strap-sealing assembly 600; guides G1, G2, and G3; and a controller 900.

The frame 100 supports some (or all) of the other components of the strapping machine 10 and may be formed of any suitable components arranged in any suitable configuration. The load supporter 300 is supported by the frame 100 and is sized, shaped, positioned, oriented, and otherwise configured to support loads—such as the object 50 shown in FIG. 1—as they are strapped by and as they move through the strapping machine 10. The load supporter 300 includes a support surface (not labeled) on which loads are positioned during strapping and over which loads move as they move through the strapping machine 10. In this example embodiment, the support surface includes multiple rollers that facilitate movement of the loads across the load supporter 300. The rollers may be driven or undriven. In other embodiments, the support surface includes any other suitable driven conveyor.

The strap chute 200 circumscribes the support surface of the load supporter 300 and defines a strap path that the strap follows when fed through the strap chute 200 and from which the strap is removed when retracted. The strap chute 200 includes two spaced-apart first and second upstanding legs (not labeled); an upper connecting portion (not labeled) that spans the first and second legs; a first lower connecting portion (not labeled) within or beneath the load supporter 300 that connects the strap-feeding assembly 400, the strap-tensioning assembly 500, and the strap-sealing assembly 600 with the first upstanding leg; and a second lower connecting portion (not labeled) within or beneath the load supporter 300. As is known in the art, the radially inward wall of the strap chute 200 is formed from multiple overlapping gates that are spring biased to a closed position that enables the strap to traverse the strap path when fed through the strap chute 200. When the strap-feeding assembly 400 exerts a pulling force on the strap to retract the strap, the pulling force overcomes the biasing force of the springs and causes the gates to pivot to an open position, thereby releasing the strap from the strap chute 200 so the strap moves radially inward into contact with the load 50. A leading-end sensor LE is positioned and configured to detect the leading end of the strap when the leading end has traversed and reached the end of the strap chute 200.

The strap-feeding assembly 400 is configured to feed strap from the strap supply and into and around the strap chute 200 and to, after the leading-end sensor LE senses the leading end of the strap and the sealing assembly 600 holds the leading end, to retract the strap so it exits the strap chute 200 and contacts the load 50. The strap-feeding assembly 400 includes a drive roller 410, a drive-roller sensor 410*s*, a pinch roller 420, a pinch-roller sensor 420*s*, and a strap-feeding-assembly actuator 430.

The drive roller 410 is cylindrical (here, disc-shaped) and is mounted to a subframe 105 (itself mounted to the frame 100) such that the drive roller 410 is rotatable relative to the subframe 105 about a drive-roller rotational axis $A_{410}$. In certain embodiments, at least part of the external cylindrical surface of the drive roller 410 is knurled or coated with a friction-enhancing coating to facilitate engaging and dispensing the strap. The strap-feeding-assembly actuator 430 (FIG. 3), which is an electric motor in this example embodiment but may include any suitable actuator, is mounted to the subframe 105 and is operably connected to the drive roller 410 and configured to drive the drive roller 410 in opposing feed (indicated in FIG. 3) and retract rotational directions. The dispenser actuator 430 may be operably connected to the drive roller 410 in any suitable manner, such as via a keyed or splined connection and/or via a suitable drive train.

The pinch roller 420 is cylindrical (here, disc-shaped) and is mounted to the subframe 105 such that the pinch roller 420 is freely rotatable relative to the subframe 105 about a pinch-roller rotational axis $A_{420}$. In certain embodiments, at least part of the external cylindrical surface of the pinch roller 420 is knurled or coated with a friction-enhancing coating to facilitate engaging and dispensing the strap.

The drive-roller sensor 410*s* (FIG. 3) is any suitable sensor configured to sense a drive-roller parameter $P_{410}$ of the drive roller 410 and to generate and send a signal representing that drive-roller parameter $P_{410}$ to the controller 900. The drive-roller parameter $P_{410}$ may be any suitable parameter related to the rotation of the drive roller 410 that is indicative of or can be used to determine the rotational speed of the drive roller 410. Some examples of the drive-roller parameter $P_{410}$ include (but are not limited to) the rotational speed of the drive roller 410 at a given point in time, the quantity of rotations of the drive roller 410 during a designated time period, or the amount of rotation of the drive roller 410 (known as its angular increment) during a designated time period. The drive-roller sensor 410*s* may be any suitable sensor such as, but not limited to, a Hall-effect sensor, a capacitive sensor, a contact-based sensor, an encoder, or an ultrasonic sensor. Similarly, the pinch-roller sensor 420*s* (FIG. 3) is any suitable sensor configured to sense a pinch-roller parameter $P_{420}$ of the pinch roller 420. The pinch-roller parameter $P_{420}$ may be any suitable parameter related to the rotation of the pinch roller 420 that is indicative of or can be used to determine the rotational speed of the pinch roller 420. Some examples of the pinch-roller parameter $P_{420}$ include (but are not limited to) the rotational speed of the pinch roller 420 at a given point in time, the quantity of rotations of the pinch roller 420 during a designated time period, or the amount of rotation of the pinch roller 420 (known as its angular increment) during a designated time period. The pinch-roller sensor 420*s* may be any suitable sensor such as, but not limited to, a Hall-effect sensor, a capacitive sensor, a contact-based sensor, an encoder, or an ultrasonic sensor.

The drive roller 410 and the pinch roller 420 are sized, shaped, positioned, and oriented such that their respective rotational axes $A_{410}$ and $A_{420}$ are generally parallel and coplanar. In this example embodiment, during the strap-feeding cycle, the pinch roller 420 is forced toward and against the drive roller 410 such that the strap S passes between the nip formed between the two rollers, as shown in FIG. 3.

The strap-tensioning assembly 500 is configured to tension the strap around the load 50. Briefly, the strap-tensioning assembly 500 includes two opposing tensioning rollers 510 and 520 and a strap-tensioning-assembly actuator (not shown) operably connected and configured to drive the tensioning rollers 510 and 520 to tension the strap to a designated (typically preset) tension. In this example embodiment, the tensioning rollers 510 and 520 and the strap-tensioning-assembly actuator are supported by the subframe 105.

The strap-sealing assembly 600 is supported by the frame 100 and configured to, after the strap-tensioning assembly 500 tensions the strap to the designated tension, cut the strap from the strap supply and form the strap loop. The manner of attaching the leading and trailing strap ends to one another depends on the type of strapping machine and the type of strap. Certain strapping machines configured for plastic strap include a strap-sealing assembly with a friction welder, a heated blade, or an ultrasonic welder configured to attach the leading and trailing strap ends to one another. Some strapping machines configured for plastic strap or metal strap include a strap-sealing assembly with jaws that mechanically deform (referred to as "crimping" in the industry) or cut notches into (referred to as "notching" in the industry) a seal element positioned around the leading and trailing strap ends to attach them to one another. Other strapping machines configured for metal strap include a strap-sealing assembly with punches and dies configured to form a set of mechanically interlocking cuts in the leading and trailing strap ends to attach them to one another (referred to in the strapping industry as a "sealless" attachment). Still other strapping machines configured for metal strap include a strap-sealing assembly with spot, inert-gas, or other welders configured to weld the leading and trailing strap ends to one another.

The strap guide G1 extends between the strap supply (not shown) and the strap-tensioning assembly 500 and is configured to guide the strap as it moves between those components. The strap guide G2 extends between the strap-tensioning assembly 500 and the strap-feeding assembly 400 and is configured to guide the strap as it moves between those assemblies. The strap guide G3 extends between the strap-sealing assembly 600 and the strap chute 200 and is configured to guide the strap as it moves between those components.

Generally, the strap-feeding assembly 400, the strap-tensioning assembly 500, and the strap-sealing assembly 600 are together configured to form a tensioned strap loop around the load 50 by feeding the strap S through the strap chute 200 in a feed direction F (FIG. 2), holding the leading strap end while retracting the strap S in the retract direction R (FIG. 2) to remove it from the strap chute 200 so it contacts the load 50, tensioning the strap S around the load 50 to a designated tension, cutting the strap S from the strap supply to form a trailing strap end, and connecting the leading strap end and the trailing strap end to one another. In this example embodiment, the strapping machine 10 is a so-called "tabletop" strapping machine in which the frame 100 supports the strap-feeding assembly 400, the strap-tensioning assembly 500, and the strap-sealing assembly 600. In other embodiments, one or more of these assemblies is not supported by the frame 100. For instance, in certain embodiments in which the strapping machine is configured to strap large loads, such as palletized loads, loads of lumber, or loads of corrugated, these assemblies are distinct, independently replaceable modules supported by different components of the strapping machine.

The controller 900 includes a processing device (or devices) communicatively connected to a memory device (or devices). For instance, the controller may be a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the strapping machine 10, such as to carry out the strap-feeding processes 1000 and 2000 described below.

In this example embodiment, as shown in FIG. 3, the controller 900 is operably connected to the strap-feeding-assembly actuator 430 and configured to control the output of the strap-feeding-assembly actuator—and therefore the rotation of the drive roller 410 of the strap-feeding assembly 400—in accordance with one or more actuator control instructions $CI_{430}$. The actuator control instructions may include (but are not limited to) actuator drive speed (e.g., the rotational speed of the actuator output shaft); actuator drive direction (e.g., feed or retract direction); and actuator drive torque.

The controller 900 is communicatively connected to the drive-roller sensor 410*s* and the pinch-roller sensor 420*s* and configured to receive the signals from the sensors representative of the sensed drive-roller parameter $P_{410}$ and pinch-roller parameter $P_{420}$, respectively. Specifically, in this example embodiment, the drive-roller sensor 410*s* and the pinch-roller sensor 420*s* are configured to periodically sense the respective parameters as the respective rollers are rotating during the strap-feeding cycle and, accordingly, to periodically send the appropriate signals to the controller 900.

The controller 900 is configured to determine a drive-roller rotational property of the drive roller 410 based on the drive-roller parameters. The drive-roller rotational property may be any suitable property related to the rotation of the drive roller 410 that is indicative of or can be used to determine the rotational speed of the drive roller 410 such as, but are not limited to, the rotational speed of the drive roller 410 at a given point in time, the average rotational speed of the drive roller 410 during the monitored time period, the quantity of rotations of the drive roller 410 during the monitored time period, or the total amount of rotation of the drive roller 410 (its total angular increment) during the monitored time period (or any combination thereof). Similarly, the controller 900 is configured to determine a pinch-roller rotational property of the pinch roller 420 based on the pinch-roller parameters. The pinch-roller rotational property may be any suitable property related to the rotation of the pinch roller 420 that is indicative of or can be used to determine the rotational speed of the pinch roller 420 such as, but are not limited to, the rotational speed of the pinch roller 420 at a given point in time, the average rotational speed of the pinch roller 420 during the monitored time period, the quantity of rotations of the pinch roller 420 during the monitored time period, or the total amount of rotation of the pinch roller 420 (its total angular increment) during the monitored time period (or any combination thereof).

The controller 900 is configured to compare the drive-roller rotational property and the pinch-roller rotational property to determine whether a slip condition is met. If the slip condition is met, one of the rollers is slipping relative to the other and the controller 900 is configured to change an actuator control instruction to reduce or eliminate the slipping.

The slip condition may differ based on the geometry of the rollers (e.g., whether they have the same diameter or different diameters) and the particular rotational properties the controller is comparing. For instance, in one example embodiment in which the drive roller and the pinch roller have the same diameter and in which the controller compares the average rotational speeds of the rollers during the monitored time period, the slip condition is met if the controller determines that the average rotational speeds differ by more than 1%. In this example embodiment, if the slip condition is met, the controller is configured to modify at least one of the actuator control instructions in a manner that will reduce the difference between the rotational speed of the drive roller and the rotational speed of the pinch roller. For example, if the controller determines that the rotational speed of the drive roller is more than 1% greater than the rotational speed of the pinch roller, the controller modifies one of the actuator control instructions $CI_{430}$ by reducing the rotational speed of the actuator output shaft of the strap-feeding-assembly actuator. This reduces the rotational speed of the drive roller and may reduce slipping and, therefore, bring the rotational speed of the drive roller closer to the rotational speed of the pinch roller.

The example embodiment shown in the figures is different than the above example because the diameter of the drive roller 410 is 3× the diameter of the pinch roller 420. This means that in a no-slip condition, the rotational speed of the pinch roller 420 is 3× the rotational speed of the drive roller 410. In this example embodiment, the slip condition is met if the ratio of the diameter of the drive roller 410 to the diameter of the pinch roller 420 and the ratio of the average rotational speed of the pinch roller 420 to the average rotational speed of the drive roller 410 differ by more than 1%. In this example embodiment, if the slip condition is met, the controller 900 is configured to modify at least one of the actuator control instructions $CI_{430}$ in a manner that will reduce the difference between the ratios.

Figure 4:
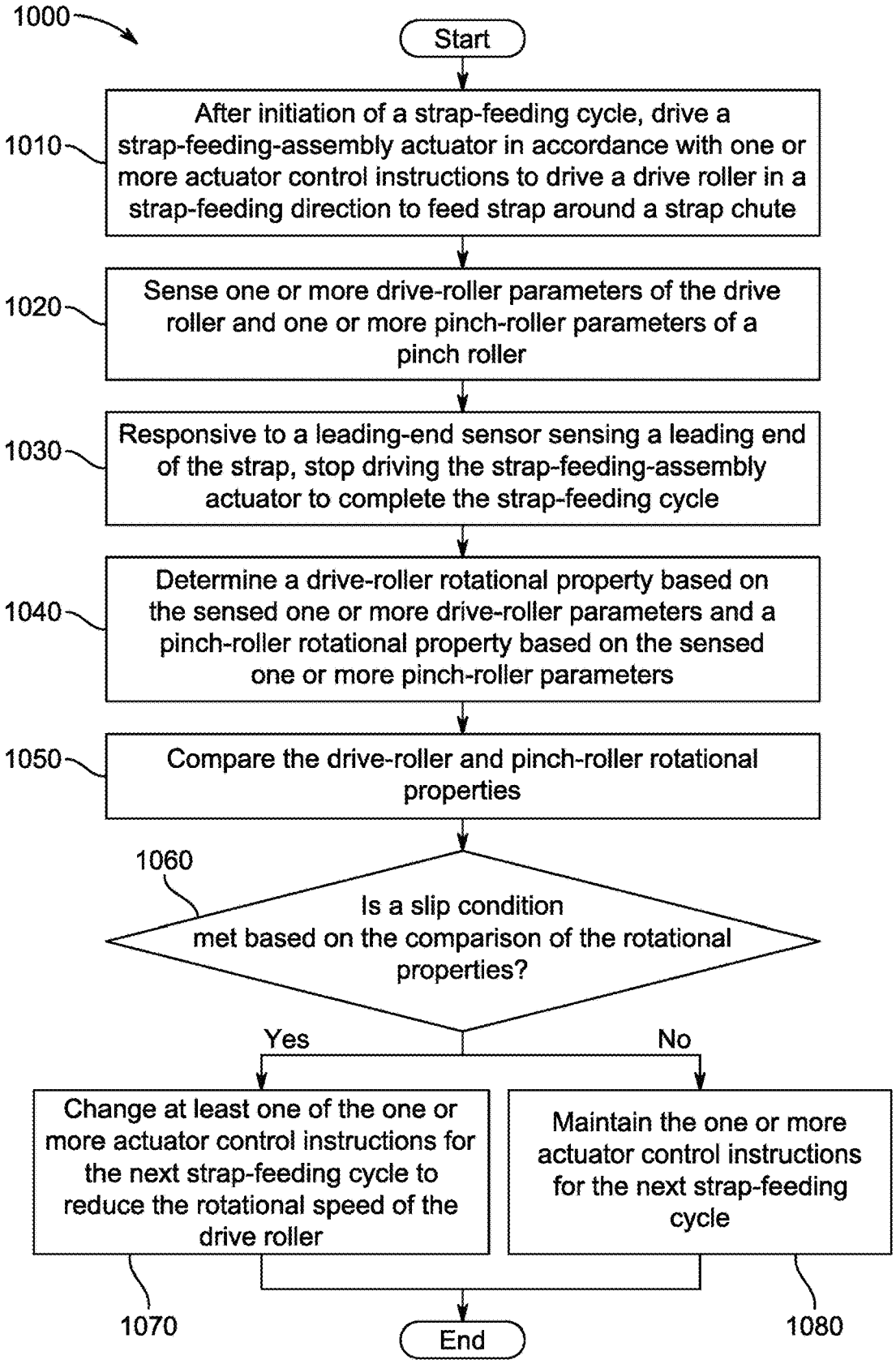
FIG. 4 is a flowchart of an example strap-feeding process of the present disclosure carried out by the strapping machine of FIG. 1.

In certain embodiments, the controller 900 is configured to compare the drive-roller rotational property to the pinch-roller rotational property during a first strap-feeding cycle and determine whether to modify at least one of the one or more actuator control instructions $CI_{430}$ to reduce the difference between the drive- and pinch-roller rotational speeds for the next strap-feeding cycle. Operation of the strapping machine 10 to carry out one such strap-feeding process 1000 is now described in accordance with the flowchart shown in FIG. 4.

After initiation of the strap-feeding cycle, the controller 900 drives the strap-feeding-assembly actuator 430 in accordance with the actuator control instructions $CI_{430}$ to drive the drive roller 410 in a strap-feeding direction to feed the strap S around the strap chute 200, as block 1010 indicates. The drive-roller sensor 410*s* senses one or more drive-roller parameters $P_{410}$ of the drive roller 410, and the pinch-roller sensor 420*s* senses one or more pinch-roller parameters $P_{420}$ of the pinch roller 420, as block 1020 indicates. In this example embodiment, the drive-roller and pinch-roller sensors periodically sense the angular increment of the drive and pinch rollers, respectively. Responsive to the leading-end sensor LE sensing the leading end of the strap S, the controller 900 stops driving the strap-feeding-assembly actuator 430 to stop the drive roller 410 and complete the strap-feeding cycle, as block 1030 indicates.

The controller 900 determines a drive-roller rotational property of the drive roller 410 based on the sensed one or more drive-roller parameters $P_{410}$ and a pinch-roller rotational property of the pinch roller 420 based on the sensed one or more pinch-roller parameters $P_{420}$, as block 1040 indicates. In this example embodiment, the controller determines the average rotational speed of each roller over the monitored time period. The controller 900 compares the drive-roller and pinch-roller rotational properties, as block 1050 indicates. In this example embodiment, the controller 900 compares the ratio of the diameter of the drive roller 410 to the diameter of the pinch roller 420 with the ratio of the average rotational speed of the pinch roller 420 to the average rotational speed of the drive roller. The controller 900 determines whether a slip condition is met based on the comparison of the drive-roller and pinch-roller rotational properties, as diamond 1060 indicates. In this example embodiment, the controller 900 determines that the slip condition is met if the ratio of the diameter of the drive roller 410 to the diameter of the pinch roller 420 and the ratio of the average rotational speed of the pinch roller 420 to the average rotational speed of the drive roller differ by more than 1% such that the controller 900 attempts to maintain at most a 1% difference between the two ratios.

If the controller 900 determines at diamond 1060 that the slip condition has been met, the controller 900 changes at least one of the one or more actuator control instructions $CI_{430}$ for the next strap-feeding cycle to reduce the rotational speed of the drive roller 410, as block 1070 indicates, and the process 1000 ends. Continuing with the above example, if the controller determines that ratios differ by more than 1%, the controller modifies one or more of the actuator control instructions to lower the rotational speed of the drive roller 410 to reduce slippage. On the other hand, if the controller 900 determines at diamond 1080 that the slip condition has not been met, the controller 900 maintains the one or more actuator control instructions $CI_{430}$ for the next strap-feeding cycle, as block 1080 indicates, and the process 1000 ends.

In certain alternative embodiments, rather than maintain the one or more actuator control instructions for the next strap-feeding cycle at block 1080, the controller changes at least one of the one or more actuator control instructions for the next strap-feeding cycle to increase the rotational speed of the drive roller, such as by a preset increment. For example, consider a scenario in which "slippery" strap is used for a strap-feeding cycle. Due to its "slippery" nature, the slip condition is met during the strap-feeding cycle, and the controller changes an actuator control instruction to reduce the speed of the drive roller. A new, less "slippery" strap coil is used for the next strap-feeding cycle. For instance the strap coil is switched from a non-embossed strap to an embossed strap. Because it is less "slippery," the slip condition is not met during the strap feeding cycle. In response, the controller changes the actuator control instruction to increase the speed of the drive roller. The slip condition is again not met during the next strap-feeding cycle, and in response the controller again changes the actuator control instruction to increase the speed of the drive roller. These embodiments enable the controller to increase and decrease the speed of the drive roller as needed from strap-feeding cycle to strap-feeding cycle to maximize the rotational speed of the drive roller.

Figure 5:
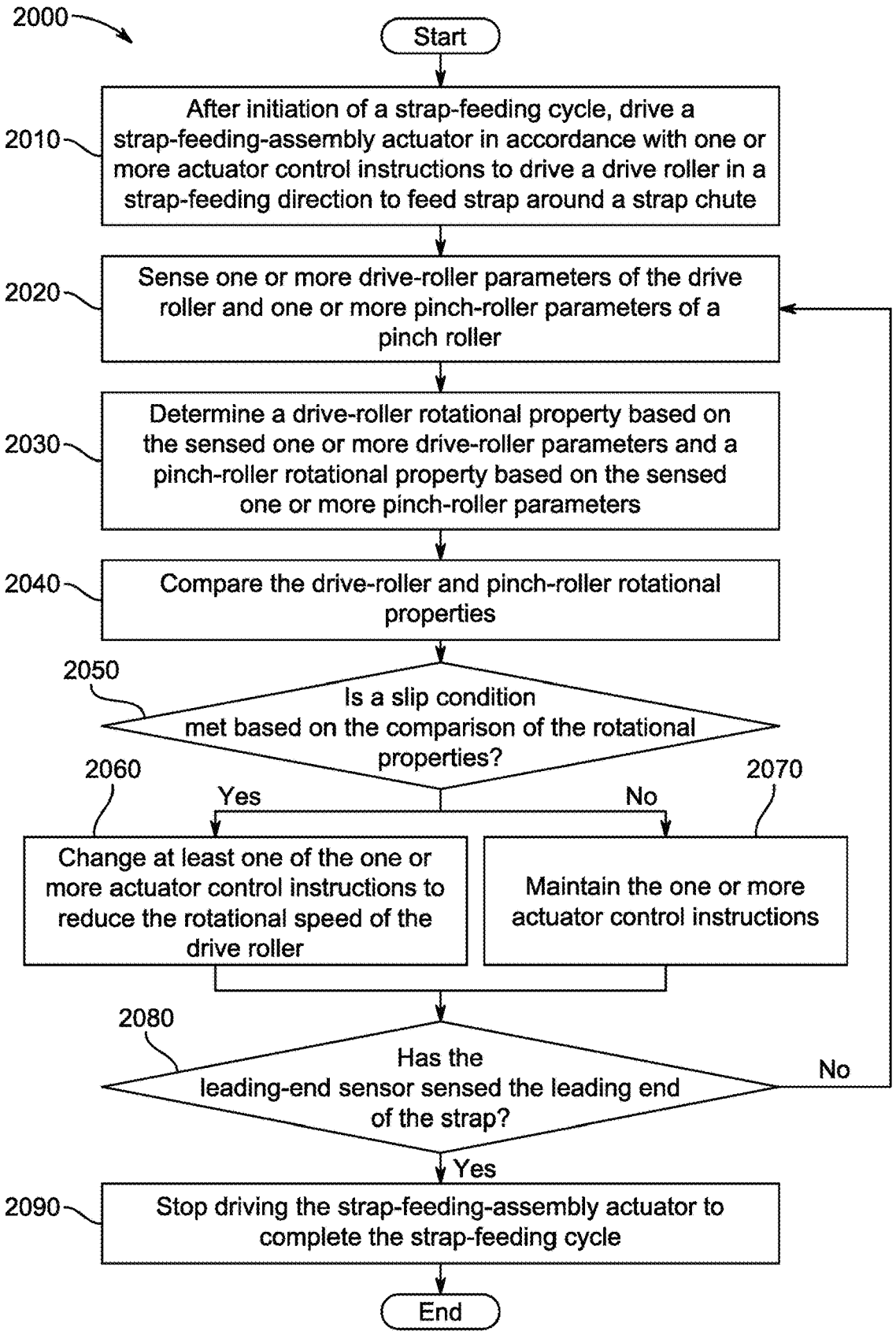
FIG. 5 is a flowchart of another example strap-feeding process of the present disclosure carried out by the strapping machine of FIG. 1.

In various embodiments, the controller 900 is configured to compare the drive-roller rotational property to the pinch-roller rotational property during a strap-feeding cycle and determine whether to modify at least one of the one or more actuator control instructions $CI_{430}$ to reduce the difference between the drive- and pinch-roller rotational speeds during that same strap-feeding cycle. Operation of the strapping machine 10 to carry out one such strap-feeding process 2000 is now described in accordance with the flowchart shown in FIG. 5.

After initiation of the strap-feeding cycle, the controller 900 drives the strap-feeding-assembly actuator 430 in accordance with the actuator control instructions $CI_{430}$ to drive the drive roller 410 in a strap-feeding direction to feed the strap S around the strap chute 200, as block 2010 indicates. The drive-roller sensor 410*s* senses one or more drive-roller parameters $P_{410}$ of the drive roller 410, and the pinch-roller sensor 420*s* senses one or more pinch-roller parameters $P_{420}$ of the pinch roller 420, as block 2020 indicates. In this example embodiment, the drive-roller and pinch-roller sensors periodically sense the angular increment of the drive and pinch rollers, respectively.

The controller 900 determines a drive-roller rotational property of the drive roller 410 based on the sensed one or more drive-roller parameters $P_{410}$ and a pinch-roller rotational property of the pinch roller 420 based on the sensed one or more pinch-roller parameters $P_{420}$, as block 2030 indicates. In this example embodiment, the controller determines the average rotational speed of each roller over the monitored time period. The controller 900 compares the drive-roller and pinch-roller rotational properties, as block 2040 indicates. In this example embodiment, the controller 900 compares the ratio of the diameter of the drive roller 410 to the diameter of the pinch roller 420 with the ratio of the average rotational speed of the pinch roller 420 to the average rotational speed of the drive roller. The controller 900 determines whether a slip condition is met based on the comparison of the drive-roller and pinch-roller rotational properties, as diamond 2050 indicates. The slip condition in this example embodiment is the same as that described for the process 1000.

If the controller 900 determines at diamond 2050 that the slip condition has been met, the controller 900 changes at least one of the one or more actuator control instructions $CI_{430}$ to reduce the rotational speed of the drive roller 410, as block 2060 indicates. On the other hand, if the controller 900 determines at diamond 2050 that the slip condition has not been met, the controller 900 maintains the one or more actuator control instructions $CI_{430}$, as block 2070 indicates.

The controller 900 determines whether the leading-end sensor LE has sensed the leading end of the strap S, as diamond 2080 indicates. If the leading-end sensor LE has not sensed the leading end of the strap S, the process 2000 returns to block 2020. On the other hand, if the leading-end sensor LE has sensed the leading end of the strap S, the controller 900 stops driving the strap-feeding-assembly actuator 430 to stop the drive roller 410 and complete the strap-feeding cycle, as block 2090 indicates.

In certain alternative embodiments, rather than maintain the one or more actuator control instructions at block 2070, the controller changes at least one of the one or more actuator control instructions to increase the rotational speed of the drive roller, such as by a preset increment. For example, consider a scenario in which a portion of a strap is "slipperier" than another. Due to its "slippery" nature, the slip condition is met while feeding this "slippery" portion of the strap during the strap-feeding cycle, and the controller changes an actuator control instruction to reduce the speed of the drive roller to reduce slippage. As feeding continues, the less "slippery" portion of the strap moves between the drive and pinch rollers. Because it is less "slippery," the slip condition is not met. In response, the controller changes the actuator control instruction to increase the speed of the drive roller. These embodiments enable the controller to increase and decrease the speed of the drive roller as needed during a single strap-feeding cycle to maximize the rotational speed of the drive roller.

The processes 1000 and 2000 may be combined in certain embodiments, with the drive-roller and pinch-roller rotational properties referred to in blocks 1040, 1050, and 1060 being the final drive-roller and pinch-roller rotational properties determined in the process 2000.

The strapping machine of the present disclosure therefore solves the above problems by actively controlling the output of the strap-feeding-assembly actuator to ensure the rotational speed of the drive roller and the rotational speed of the pinch roller stay relatively close to one another (as established by the particular slip condition). This reduces (and for certain slip conditions, effectively eliminates) slipping between the rollers and the strap to optimize the strap-feeding cycle.

In certain embodiments, the controller is configured to monitor the drive-roller rotational property relative to a cutoff threshold, which again may be set by the operator. For instance, if the drive-roller rotational property is average rotational speed, the cutoff threshold may be a low-speed threshold. If the drive-roller rotational property falls below the cutoff threshold, the controller is configured to generate an output, such as a displayed or audio message. This output alerts the operator that the drive roller and/or pinch roller need inspection and replacement and/or cleaning and/or that the quality of the strap should be checked.

As explained above, the pinch roller is forced toward and against the drive roller such that the strap passes between the nip formed between the two rollers, which enables the drive roller to drive the strap. In various embodiments, the strap-feeding assembly includes a pinch-roller actuator operably connected to the pinch roller and configured to move the pinch roller toward and away from the drive roller. In certain such embodiments, if the controller determines that the slip condition has been met, the controller is configured to control the pinch-roller actuator to, either in addition to or instead of changing at least one of the one or more actuator control instructions, move the pinch roller toward or away from the drive roller to reduce the difference between the rotational speed of the drive roller and the rotational speed of the pinch roller.

In various embodiments, rather than using sensors to provide feedback to the controller and enable the controller to determine the rotational properties of the rollers, the controller is programmed to change at least one of the one or more actuator control instructions to change the rotational speed of the drive roller based on the quantity of strapping cycles completed by the strapping machine, with the programming being based on an anticipated wear profile for the drive roller.

The invention claimed is:

1. A strapping machine comprising:

a frame;

a load supporter supported by the frame and comprising a support surface;

a strap chute circumscribing the support surface of the load supporter;

a drive roller;

an actuator operably connected to the drive roller to drive the drive roller;

a rotatable pinch roller that forms a nip with the drive roller sized to receive strap therethrough;

a drive-roller sensor configured to sense a drive-roller parameter of the drive roller;

a pinch-roller sensor configured to sense a pinch-roller parameter of the pinch roller;

a controller operably connected to the actuator and communicatively connected to the drive-roller and pinch-roller sensors, wherein the controller is configured to:

during a strap-feeding cycle, control the actuator in accordance with one or more actuator control instructions to drive the drive roller to feed the strap around the strap chute;

determine a drive-roller rotational property of the drive roller based on one or more drive-roller rotational parameters sensed while the strap is being fed around the strap chute;

determine a pinch-roller rotational property of the pinch roller based on one or more pinch-roller rotational parameters sensed while the strap is being fed around the strap chute;

determine whether a slip condition has been met based on a comparison of the drive-roller rotational property with the pinch-roller rotational property; and responsive to determining that the slip condition has been met, change at least one of the one or more actuator control instructions to reduce the rotational speed of the drive roller in a next strap-feeding cycle.

2. The strapping machine of claim 1, wherein the controller is further configured to stop the strap-feeding cycle by controlling the actuator to stop the drive roller from feeding the strap around the strap chute.

3. The strapping machine of claim 1, wherein the drive-roller rotational property comprises an average rotational speed of the drive roller, wherein the pinch-roller rotational property comprises an average rotational speed of the pinch roller, wherein the controller is further configured to determine the average rotational speed of the drive roller based on multiple drive-roller parameters sensed during a designated time period, wherein the controller is further configured to determine the average rotational speed of the pinch roller based on multiple pinch-roller rotational parameters sensed during the designated time period.

4. The strapping machine of claim 1, wherein the drive-roller parameter comprises one of a rotational speed, an angular increment, and a quantity of rotations, and wherein the pinch-roller parameter comprises one of a rotational speed, an angular increment, and a quantity of rotations.

5. The strapping machine of claim 1, wherein the controller is further configured to, responsive to determining that the slip condition has not been met, change at least one of the one or more actuator control instructions to increase the rotational speed of the drive roller.

6. A method of operating a strapping machine, the method comprising:

during a strap-feeding cycle, driving an actuator in accordance with one or more actuator control instructions to drive a drive roller to feed a strap around a strap chute of the strapping machine;

determining a drive-roller rotational property of the drive roller based on one or more drive-roller rotational parameters sensed while the strap is being fed around the strap chute;

determining a pinch-roller rotational property of a pinch roller based on one or more pinch-roller rotational parameters sensed while the strap is being fed around the strap chute, wherein the pinch roller forms a nip with the drive roller sized to receive the strap therethrough;

determining whether a slip condition has been met based on a comparison of the drive-roller rotational property with the pinch-roller rotational property; and responsive to determining that the slip condition has been met, changing at least one of the one or more actuator control instructions to reduce the rotational speed of the drive roller in a next strap-feeding cycle.

7. The method of claim 6, further comprising stopping the strap-feeding cycle by controlling the actuator to stop the drive roller from feeding the strap through the strapping machine.

8. The method of claim 6, wherein the drive-roller rotational property comprises an average rotational speed of the drive roller, wherein the pinch-roller rotational property comprises an average rotational speed of the pinch roller, the method further comprising:

determining the average rotational speed of the drive roller based on multiple drive-roller parameters sensed during a designated time period; and determining the average rotational speed of the pinch roller based on multiple pinch-roller rotational parameters sensed during the designated time period.

9. The method of claim 6, wherein the drive-roller parameter comprises one of a rotational speed, an angular increment, and a quantity of rotations, and wherein the pinch-roller parameter comprises one of a rotational speed, an angular increment, and a quantity of rotations.

10. The method of claim 6, further comprising, responsive to determining that the slip condition has not been met, changing at least one of the one or more actuator control instructions to increase the rotational speed of the drive roller.

* * * * *